United States Patent [19]

Kunkel

[11] 4,214,627

[45] Jul. 29, 1980

[54] FIRE TUBE FOR A HEATING BOILER

[75] Inventor: Wolfgang Kunkel, Triesen, Liechtenstein

[73] Assignee: Interliz Anstalt, Vaduz, Liechtenstein

[21] Appl. No.: 958,854

[22] Filed: Nov. 7, 1978

[30] Foreign Application Priority Data

Nov. 9, 1977 [DE] Fed. Rep. of Germany ... 7734356[U]

[51] Int. Cl.[2] ..... F28F 1/40

[52] U.S. Cl. ..... 165/179; 110/326; 122/149; 138/38

[58] Field of Search ..... 122/136 R, 149, 367 R; 110/326; 165/179, 183; 138/38

[56] References Cited

U.S. PATENT DOCUMENTS

| | | | |
|---|---|---|---|
| 2,247,199 | 6/1941 | Kritzer | 165/179 X |
| 2,378,646 | 6/1945 | Manning | 165/179 X |
| 2,930,405 | 3/1960 | Welsh | 138/38 |

*Primary Examiner*—Edward G. Favors

*Attorney, Agent, or Firm*—Jordan and Hamburg

[57] ABSTRACT

A fire tube for a heating boiler comprising two metal tube halves each having a base portion and two leg portions projecting at an angle from the base portion, the tube halves being disposed relative to one another such that the terminating ends of the leg portions abut one another and are joined by welding. A plurality of substantially U-shaped elements extend longitudinally within the fire tube, each of the U-shaped elements having a base section and projecting leg sections, the base sections being welded to the base portion of one of the tube halves, the leg sections being parallel to one another and extending substantially across the width of the fire tube.

7 Claims, 4 Drawing Figures

FIRE TUBE FOR A HEATING BOILER

BACKGROUND OF THE INVENTION

In heating boilers, particularly in heating boilers with a burner for liquid or gaseous fuels, it is usual to conduct the combustion gases emerging from a combustion chamber through fire tubes before they leave the heating boiler. The fire tubes traverse the water compartment of the boiler which surrounds the combustion chamber, and form ancillary heating surfaces for the better utilization of the heat of the combustion gases. Cylindrical fire tubes are known which are provided with inwardly stamped ribs or currugations in the cylindrical tube wall in order to increase the turbulence of the combustion gases in the fire tubes and the heat transfer from the combustion gases to the fire tube. This means only leads to a satisfactory result in tubes with a comparatively small cross-section. However, small tube cross-sections necessitate a large number of individual flue-gas tubes, and therefore a large number of watertight welds of the tube ends into the boiler walls.

Also known are fire tubes with a square cross-section, for example, which consist of two tube halves of metal, shaped at an angle, which are welded together at their edges abutting at two opposite corners of the square cross-section. At the abutting edges, one of the two tube halves is provided with an angled bend directed towards the inside of the tube. These fire tubes therefore have only in the two opposite corners of the square cross-section, where the tube halves are welded together, a metal strip projecting diagonally into the interior of the tube as an additional heating surface of the fire tube.

In the present invention two U-shaped tube halves are constructed with a broad profile base and with short profile arms bent at an angle so that the two tube halves form in cross-section a pocket-like flat tube with two broad plane side surfaces and two narrow side surfaces on which longitudinal welding seams connect the profile arms of the two tube halves. These pocket-like flat fire tubes have a comparatively large cross-section so that the ancillary heating surface of a heating boiler can be formed with a smaller number of such fire tubes. With these pocket-like flat fire tubes, it is known to provide the broad plane side surfaces of the tube with corrugations extending transversely to the longitudinal direction of the tube and projecting inwards so as to achieve, in this manner, an increase in the heat transfer from the combustion gases to the ancillary heating surface formed by the fire tube. In comparison, the construction of such a pocket-like flat fire tube according to the present invention is such as to have the advantage that a significant increase in the heating surface and the heat-exchange performance of the fire tube is achieved with simple means which are inexpensive to produce. Consequently, the burner capacity of a heating boiler can be increased without an unwanted increase in the waste-gas temperature of the boiler, or it is possible to manage with an even smaller number of fire tubes as the ancillary heating surface of a heating boiler with a predetermined burner capacity and waste-gas temperature.

According to one embodiment of the invention L-shaped metal strips arranged side-by-side like a comb on the inner profile base of a tube half may be separate metal strips which can be welded in pairs to the profile base very easily and simply by a single common welding seam, for example with automatic welding machines. Also it is a particular advantage to form two such L-shaped metal strips integrally from a single metal strip which is bent into a U-shape configuration and which, as a result of its U-shaped configuration, is provided with a stamped out longitudinal slot which is interrupted by narrow transverse webs holding together the two L-shaped halves of the U-section. The U-section can be welded in a simple manner, for example by welding with an automatic machine, to the profile base of the tube half, firmly and with good heat conduction, through the longitudinal slot.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
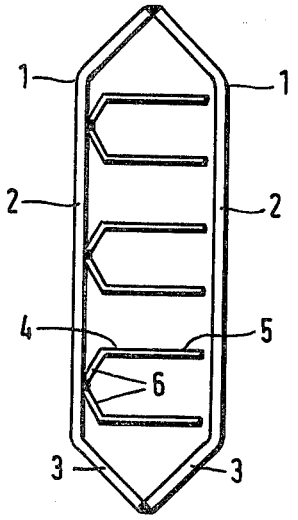
FIG. 1 shows a cross-section through a fire tube constructed according to one embodiment of the invention.

The fire tube illustrated in FIG. 1 consists of two substantially U-shaped metal tube halves 1 which have a broad profile base 2 and comparatively short profile arms 3 bent at an angle. The two tube halves 1 form a flat tube with a pocket-shaped cross-section, the profile arms 3 forming the narrow sides of the flat tube on which watertight longitudinal welding seams join the abutting edges of the profile arms 3. The narrow side surfaces of the flat tube advantageously extend outwardly to converge or form a point which simplifies and facilitates the welding of the welding seam between the edges of the profile arms.

At the inside of the profile base 2 of one tube half 1, a plurality of L-shaped metal strips 4 are disposed which extend in the longitudinal direction of the fire tube, and one L-shaped arm 5 of which projects at right angles from the profile base 2 of the tube half 1 and extends almost to the opposite profile base of the other tube half. The other L-shaped arms 6 of these metal strips 4 face one another in pairs and are connected at their edges by a common welding seam to the profile base of the tube half 1.

Alternatively, the two L-shaped sheet-metal strips 4 can be formed in a particularly simple and advantageous manner from a single metal strip bent into a U-shaped configuration so that the adjacent arms 6 coherently form the base of this U-shape. In such a case, the base of the U-section is provided in the middle thereof with stamped out longitudinal slots 9 which are interrupted by narrow transverse webs 10 holding the arms 6 together. The welding seam illustrated in FIG. 1 is welded through the portions of the longitudinal slots and connects the whole metal strip bent into U-shape firmly and in a heat-conducting manner to the profile base 2 of the tube half 1.

Figure 2:
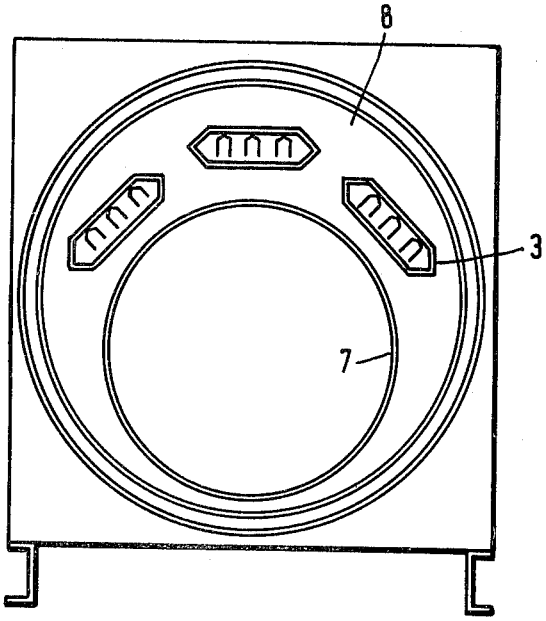
FIG. 2 shows the use of the fire tube of FIG. 1 as an ancillary heating surface in a heating boiler.
Figure 3:
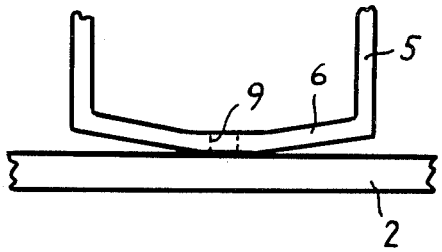
FIG. 3 is a cross-section of an alternate embodiment.
Figure 4:
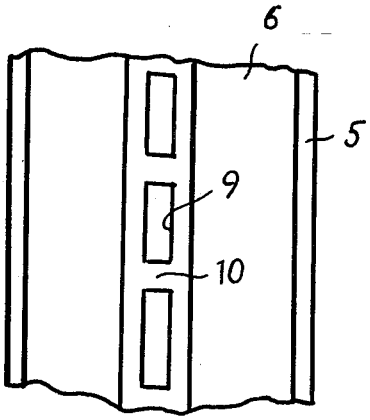
FIG. 4 is a partial top view of FIG. 3.

Such an increase in the heat-exchange surface and heat-transfer capacity of the fire is achieved by the sheet-metal strips 4 welded in the form of a comb to the inside of the profile base of one tube half that an effective ancillary heating surface of a heating boiler can be provided with few fire tubes of the construction described and illustrated. Whereas heretofore known flat-tube type fire tubes were disposed with their broad lateral surfaces side-by-side in order to be able to accommodate the necessary number of flat-tube type fire tubes in the widened peripheral portion of the water jacket of a heating boiler surrounding a combustion chamber. As a result of the fire tube construction according to the invention, which permits a reduction in the number of fire tubes, it is possible to dispose the individual fire tubes as illustrated in FIG. 2 with their narrow lateral surfaces adjacent to one another, that is to say with their large cross-sectional width extending substantially in the peripheral direction of the heating boiler in the widened portion of a boiler water jacket 8 surrounding a combustion chamber 7. In this case, the pointed construction of the profile arms 3 of the two tube halves 1 of the individual fire tubes also has advantages with regard to the guiding of the water in the boiler water jacket directed in the peripheral direction of the heating boiler.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A fire tube for a heating boiler comprising two metal tube halves, each tube half having a base portion and two leg portions projecting at an angle from said base portion, said tube halves being disposed relative to one another such that the terminating ends of said leg portions abut one another, first welding means joining said abutting ends, a plurality of substantially U-shaped elements extending longitudinally within the fire tube, each of said U-shaped elements having a base section and projecting leg sections, and second welding means joining said base sections to said base portion of one of said tube halves, said leg sections of said U-shaped elements being parallel to one another and extending substantially across the width of said fire tube.

2. A fire tube according to claim 1 wherein said U-shaped elements comprise a pair of substantially L-shaped members each having a first part which defines a leg section of said U-shaped element and a second part which defines a portion of the base section of the U-shaped element, said second welding means joining said second parts to said base portion of said one tube half, whereby said two parts form said base section of the U-shaped element.

3. A fire tube according to claim 1 wherein said U-shaped elements are integrally formed, and means in the base section of the U-shaped elements forming spaced slots, said second welding means being disposed in said slots.

4. A fire tube according to claim 1 wherein said base portions of said metal tube halves have a cross-sectional length greater than the cross-sectional length of said leg portions.

5. A fire tube according to claim 4 wherein said leg portions of said metal tube halves converge towards said first welding means.

6. A fire tube according to claim 1 wherein said base sections and said leg sections of said U-shaped elements are disposed at an obtuse angle relative to one another.

7. A fire tube according to claim 6 wherein said base section of said U-shaped element has two parts which converge towards one another toward said second welding means.

* * * * *